US005141228A

United States Patent [19]

Soong

[11] Patent Number: 5,141,228

[45] Date of Patent: * Aug. 25, 1992

[54] SHOCK ABSORBING STRING POST FOR SPORTS RACKETS

[76] Inventor: Tsai C. Soong, 1839 Jackson Rd., Penfield, N.Y. 14625

[ * ] Notice: The portion of the term of this patent subsequent to Jan. 29, 2008 has been disclaimed.

[21] Appl. No.: 687,576

[22] Filed: Apr. 19, 1991

[51] Int. Cl.[5] ..... A63B 51/10

[52] U.S. Cl. ..... 273/73 D; 273/73 G

[58] Field of Search ..... 273/73 R, 73 C, 73 G, 273/73 E, 73 D, 73 H

[56] References Cited

U.S. PATENT DOCUMENTS

| | | | |
|---|---|---|---|
| 1,663,039 | 3/1928 | Craven | 273/73 E |
| 1,790,156 | 1/1931 | Kleinman | 273/73 E |
| 2,165,701 | 7/1959 | Goerke | 273/73 E |
| 2,206,548 | 7/1940 | Goerke | 273/73 E |
| 4,026,553 | 5/1977 | Vendramiri | 273/73 E |
| 4,099,717 | 7/1978 | Sacks | 273/73 E |
| 4,322,076 | 3/1982 | Bertram et al. | 273/73 G |
| 4,333,650 | 6/1982 | Soong | 273/73 G |
| 4,437,662 | 3/1984 | Soong | 273/73 G |
| 4,634,124 | 1/1987 | Yuhas et al. | 273/73 G |
| 4,829,259 | 5/1989 | Davis | 273/73 C |
| 4,988,101 | 1/1991 | Soong | 273/73 D |

*Primary Examiner*—Paul E. Shapiro
*Assistant Examiner*—Steven B. Wong
*Attorney, Agent, or Firm*—Bernard A. Chiama

[57] ABSTRACT

A damping device is disclosed for application to longitudinal strings of a string network used in sports rackets having a frame comprising a head, side portions and a throat section supporting the side portions. At least some of the longitudinal strings are directed toward and around a string post or anchoring member mounted within the throat section, wherein the turning around is in the plane of the string network. A damping device is positioned between the string post and a string seating member for the strings where the latter are turned around the post.

8 Claims, 3 Drawing Sheets

SHOCK ABSORBING STRING POST FOR SPORTS RACKETS

BACKGROUND OF THE INVENTION

Suppression of shock and vibration in a sports racket has been a critical design goal that has eluded experts in the field. The prior art is very extensive in descriptions of arrangements designed to reduce vibration in a racket frame by means of using foam material, composite material, in sandwich form or in homogeneous types, by means of vibration dampers near the top of the frame or near the throat either in separate attachments or as an integral part of the frame, attached on strings or on frames, etc. In these arrangements employing vibration dampers attached on strings, most are installed locally near the throat or the head which can affect only a few nearby strings. However, since disturbance caused by the impact of a ball spreads far and wide in the whole string network, damping of a few strings cannot be very effective.

In the prior art, U.S. Pat. No. 4,322,076 to Bertram et al discloses longitudinal strings which are bent, except for the through which the strings extend and against which they slide. The specification does not suggest the additional purpose of damping, on the contrary, the function encountered in the racket throat from the sliding of the bent strings in the face 2 would render such damping ineffective.

Similarly, in U.S. Pat. Nos. 1,663,039, 1,790,156, 2,165,701, 2,206,548 and 4,099,717 disclose arrangements wherein passing strings are bent along the way to an anchoring means which are utilized for mechanically adjusting the longitudinal strings at or near their respective handles. Vibration damping the collected strings at a single anchoring point was never intended by the patentees, nor could their design arrangements adapt to such a possibility.

The present invention was devised to overcome the problems discussed above and considers that the longitudinal string group, which transmits the major portion of the shock load to the hand, may be channeled toward the handle in a converging manner such that a localized shock absorbing devise, installed at the converging point of these strings, may damp a large number of the longitudinal strings effectively to achieve the purpose of shock absorbing of the frame to a degree that was not possible before. The success of this arrangement depends upon two aspects of the design: 1) a large number of the longitudinal strings should be led toward that localized damping device; 2) the damping device has to be simple, easily installed, replaceable and effective.

The invention is particularly applicable to a sports racket which employs a network consisting of longitudinal strings and cross strings, the majority of longitudinal strings in the central portion of the string network, along the longitudinal axis of the racket, being directed in a fanout arrangement from the center of the network narrowing toward the handle, where at least a third of the longitudinal strings are anchored in the shank region between the throat and the handle. These longitudinal strings are preferably anchored at a single post in the shank region.

In the present invention, the affected longitudinal strings are wound around curved concentric openings formed in a string contact element of a string seating member attached to a string post which is secured to the racket frame. These concentric openings are approximately in the plane of or parallel to the string network while the string post is approximately perpendicular thereto. A shock absorbing material is positioned between the string post and the string contact element for damping the string vibration of the longitudinal strings entering and exiting the seating member set.

The present invention is an improvement of the invention disclosed and claimed in U.S. Pat. No. 4,988,101 to the inventor. In the patented device, the longitudinal strings being damped are wrapped around a string contact element wherein the wrapped portions of the strings are located in planes which are approximately normal to the plane of the string network rather than in a plane approximately parallel to the plane of the string network.

DESCRIPTION OF THE DRAWINGS

FIG. 5*a* is an elevational view of the string contact element in FIG. 5*a*.

PREFERRED EMBODIMENT OF THE INVENTION

Figure 1:
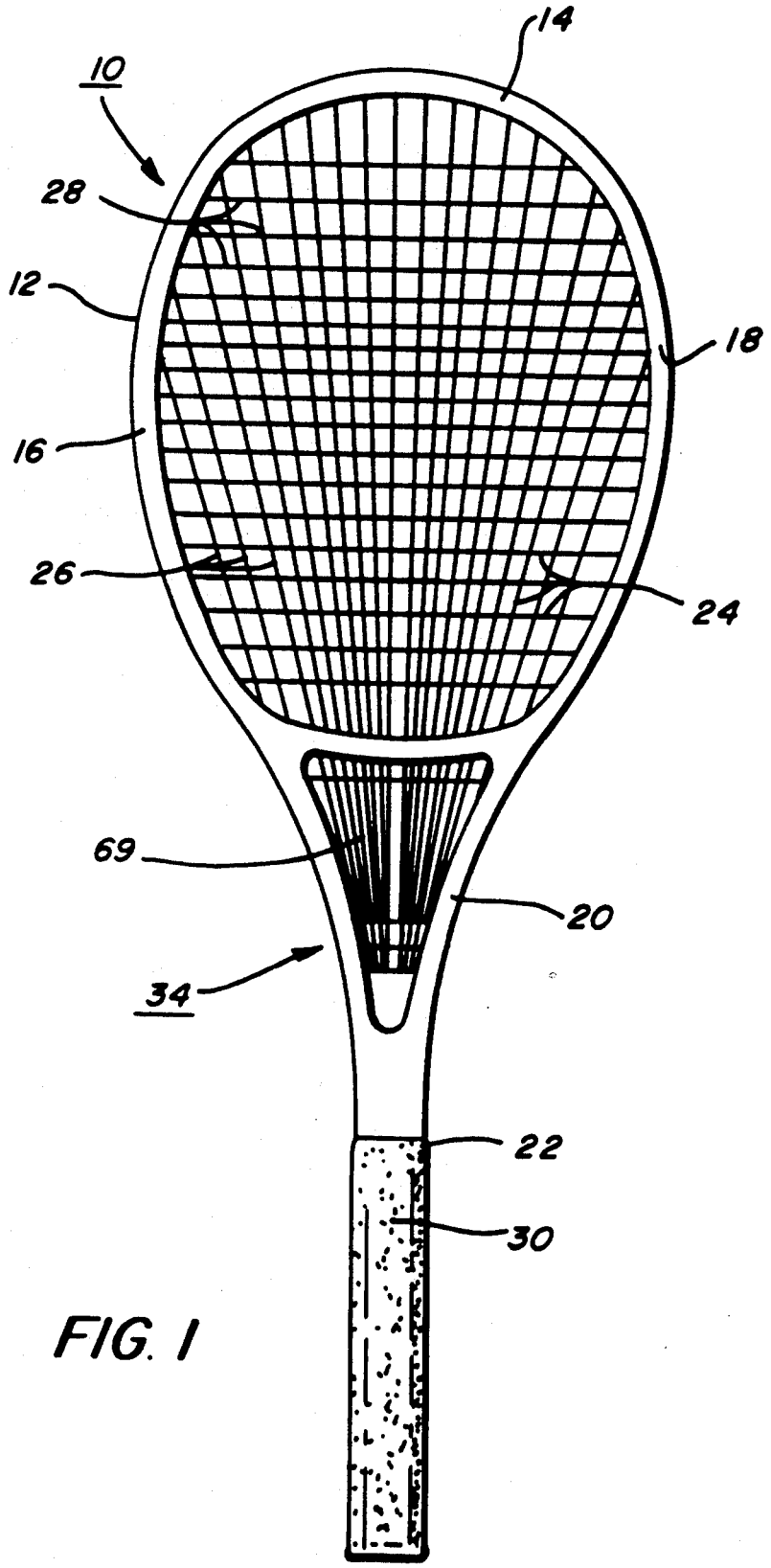
FIG. 1 is a plan view of a tennis racket having some of the longitudinal strings of a string network converging toward a string seating post member.

Referring to the drawings, there is shown in FIG. 1 a sports racket, for example, a tennis racket, indicated generally by the reference numeral 10, embodying the present invention. While a tennis racket is illustrated, it will be understood that the present invention is equally applicable to rackets used in badminton, squash and racquet ball.

The racket 10, as in conventional tennis rackets, includes a frame 12; having a top section or head 14; side sections 16, 18; a throat 20 supporting the head and a handle 22. Within the top section or head 14, between the side sections 16, 18 is a string network 24 comprising longitudinal strings 26 and parallel cross or transverse strings 28. As in conventional rackets, the frame 12 is formed with openings to receive the strings.

The present invention is particularly applicable to sports rackets wherein the longitudinal strings 26 are strung upon the frame 12, having a portion of the central strings with axes converging approximately to a point 30 located in the handle 22, as shown in FIG. 1. The transverse strings 28, on the other hand, are arranged with their axes parallel. It is also significant to the present invention that the tension placed upon the string network 24 during stringing of the racket 10 is such that the tension on the longitudinal strings is greater than that for the transverse strings.

With a longitudinal string network, as illustrated, having a curved top section and narrowing down to the throat section, the network is triangular shaped, elastically supported at its top side and supported along a large portion of its two lateral side sections 16, 18, with the rest almost free until it reaches an end point in the form of an anchoring string seating member generally indicated by the reference numeral 34. Optimum results are achieved by having the transverse strings 28 at the relatively low tension and the longitudinal strings at a higher tension, about 50% to 90% higher in tension than the transverse string tension.

With this arrangement, the transverse string system will let the ball sink deeper into the network and allow the longitudinal strings 26 to provide the predominating force to resist the impact of a ball. In view of this role played by the converging longitudinal strings 26, the present invention is directed to an arrangement wherein a vibration and shock damping means for the longitudinal strings is applied to the anchoring seating member 34 and out of the immediate vicinity of the string network 24. The damped end of the string system will damp a shock load because all three sides of the network will allow the lower end of the network to move and be damped.

Figure 2:
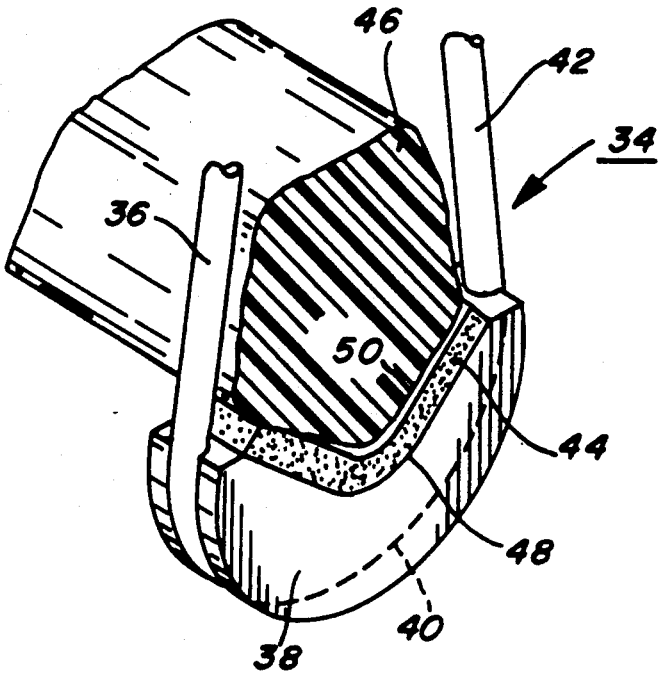
PRIOR ART FIG. 2
FIG. 2 is a fragmentary view of a string seating member as devised in the prior art.

A large number of the longitudinal strings 26 in FIG. 1, preferably not less than one-third of the total number of longitudinal strings, are led toward the shank region 20. Some of such strings, especially those near the side of the frame, have to be inclined with respect to the longitudinal axis of the racket frame 12 in order to be channeled into the narrowing shank region. In the arrangement disclosed in U.S. Pat. No. 4,988,101, as shown in FIG. 2, a string 36 is wound around a string contact element 38, smooth at its exposed surface 40, arranged in contact with the string and serving as a hub for the strings to be wound around. The other end 42 of the string is led back toward the string network 24. The string contact element is pressed against a pad 44 of damping material sandwiched between the contact element 38 and a seat post 46 which is connected to the frame at the shank region 20. Adhesive material may be applied at the interface surfaces 48, 50 between the string seat 38 and the pad 44, and the pad and the post 46, respectively.

In the present invention, as shown in FIGS. 3, 4*a*, 4*b*, 5*a* and 5*b*, the shank or throat region 20 of the racket frame 12 includes a string seating member, generally indicated by the reference numeral 70, which is an advantageous modification of the seating member 34 in the above-recited U.S. Pat. No. 4,988,101.

The seating member comprises a seat post 72 having parallel, spaced apart sections 72*a*, 72*b* which are a rigid part connected to the frame of the shank region 20, a string contact element 74 having an extension 75 adapted to extend between and be supported by the post sections 72*a*, 72*b* and around which some of the longitudinal strings of the string network are placed, as will be discussed below, and a pad 76 of damping material sandwiched between the element 74 and the seat 72. Adhesive material 78 may be applied at the interface surfaces between the string contact element 74 and the damping pad, and the damping pad and the seat post 72.

Figure 3:
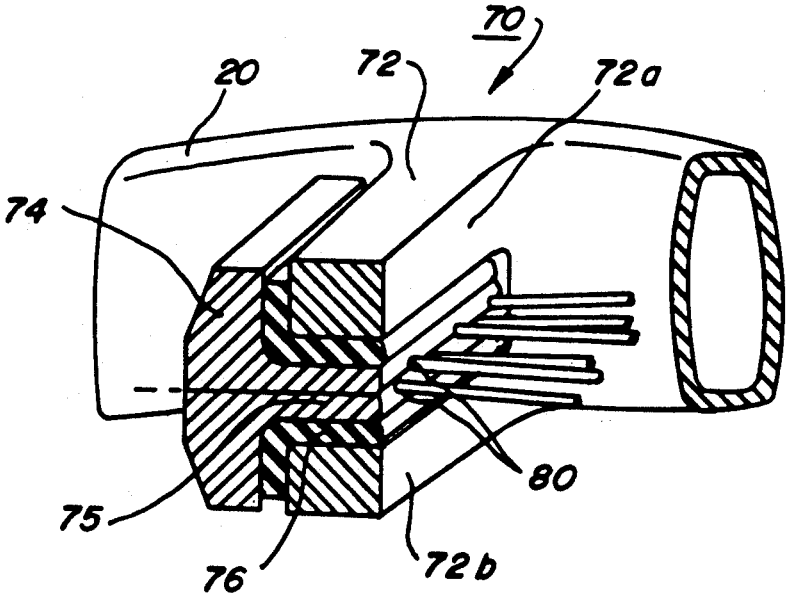
FIG. 3 a fragmentary view in perspective of the string seating member devised in accordance with the invention.

As shown in FIG. 3, a portion of the longitudinal strings of the string network 24, at least a third of the total of these strings shown at 69, are directed to the seating member 70 in a converging orientation with the member being adapted to serve as a hub for the strings to be wound around. The string seat 74 is formed with a plurality of interior string passage openings 80 through which affected portions of the longitudinal strings are seated, guided and retained under high tension from inlet to exit.

The converging strings go into the string contact element 74, winding about a curved channel and exit from it approximately in a plane which is approximately coinciding or parallel to the plane of the string network. Since all that is necessary is to have the string enter and exit, there could be a number of arrangements devised to accommodate the required geometry.

Figure 4A:
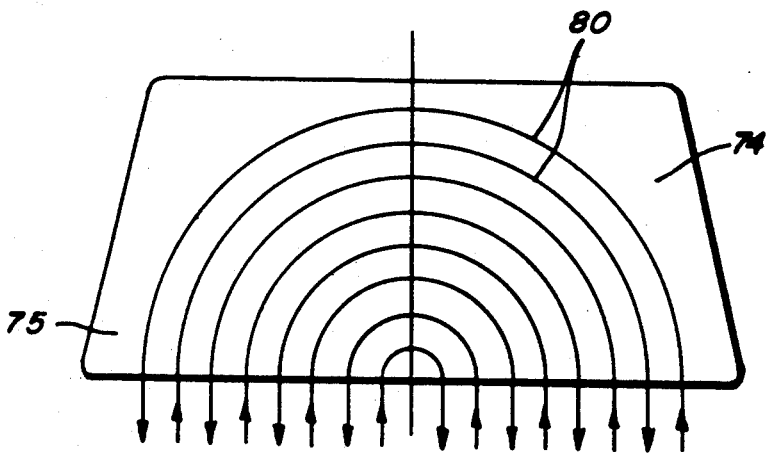
FIG. 4*a* is a plan view of a schematic illustration of one embodiment of a string contact element.
Figure 4B:
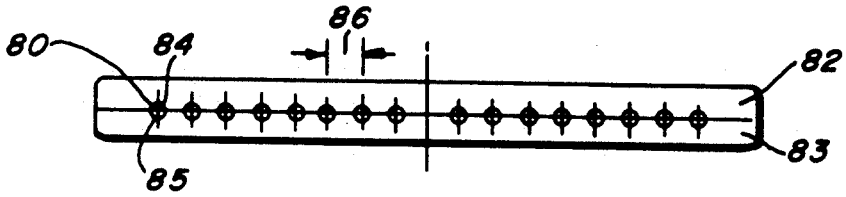
FIG. 4*b* is an elevational view of the string contact element in FIG. 4*a;*

Two preferred arrangements are illustrated in FIGS. 4*a*, 4*b* and 5*a*, 5*b*, respectively. In the embodiment of FIGS. 4*a*, 4*b*, two identical halves 82, 83 of the element 74 are shown one above the other and symmetrically arranged. The diameter of the grooves 84, 85, defining the openings 80, and which houses the string may be slightly larger than the diameter of the string with each of the half 82, 83 containing half of the required diameter. In its simplest orientation, the grooves 84, 85 may be concentric circular arcs, as shown.

A potential problem is that the overall width of the string contact element 74 may have to be small in order to be placed within the confined width of the shank region 20 and the spacing 86 between adjacent string holes may not be large enough to accommodate two strings. For example, for tennis rackets, the space at the shank may be 40 mm. To place 16 main strings within the space allowed, the center-to-center distance between two adjacent holes is about 2.4 mm which leaves only 1.0 mm as the wall thickness between adjacent holes.

Figure 5A:
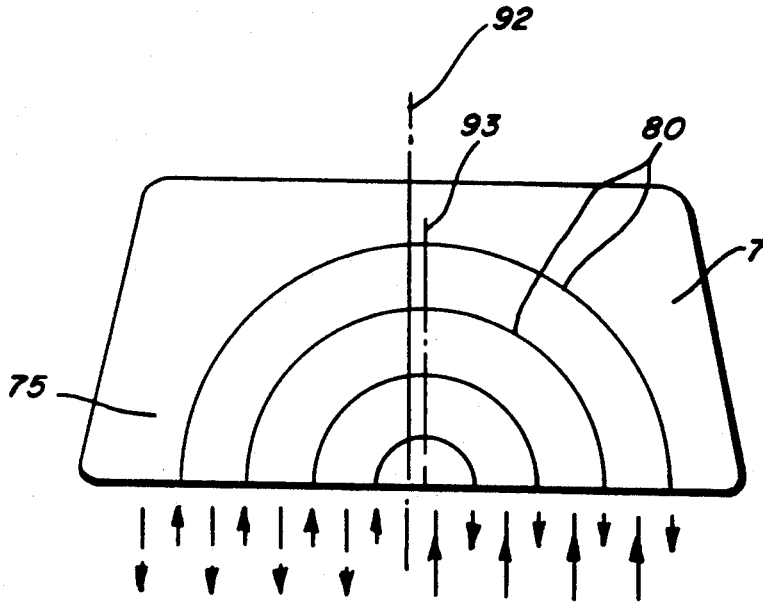
FIG. 5*a* is a plan view of a schematic illustration of another embodiment of the string contact element.
Figure 5B:
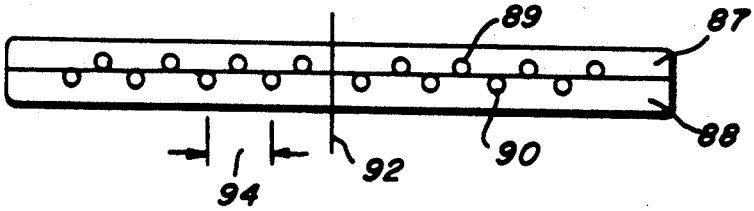

In FIGS. 5*a*, 5*b*, the preferred embodiment is illustrated. The two halves 87, 88 of the string contact element 74 are identical. For 16 strings, each half is formed with four openings 89, 90, respectively into which the strings reside completely in each half with the centerline 92 of the contact element 74 being eccentric to the centerline 93 of the circle openings 89, 90. When such two identical halves of element 74 are brought together, and one half 87 is turned over and placed on the other half 88, there is a 16 hole pattern arranged exactly the same as the contact element embodiment of FIGS. 4*a*, 4*b*, except 8 holes are slightly above the other 8 holes. For a racket, this slight difference in elevation with respect to the plane of the string network has no effect on performance or serve. The spacing 94 of FIG. 5*a* is now twice that of 86 of FIG. 4*a*. This innovative, simple design resolves the difficulty of the FIG. 4*a* embodiment regarding the wall thickness between adjacent holes.

The merits of the arrangement of FIG. 3 compared to that of the prior art in FIG. 2, as described in the above-cited patent, are two-fold. One merit concerns difficulties in the stringing of a sports racket. The longitudinal strings winding around the post 46 in the prior art of FIG. 2 are inclined at a large angle with respect to the plane of the string network. This makes the meshed strings very tight and very difficult to pull during stringing near the throat region where the inclined strings meet the flat cross strings to form a mesh.

The second merit relates to damping. The damping layer 44 of the prior art is compressed very tightly both along the vertical and along the axial dimensions. This tight compression reduces the ability of the viscoelastic material for damping. However, for the present invention of FIG. 3, the vertical area of the damping layer compressed between the element 74 and the post 72*a* and 72*b* is still compressed as in the FIG. 2 design of the prior art, but the horizontal area in the extended portion 75 is mostly uncompressed. When a ball hits the network and the network near the throat is bounced up and down in the direction perpendicular to the axis 75, the damping material can exert its full influence to reduce the shock transmitted from the string network to the frame 20. Since most main strings are converging to that post, the single flat damping layer 76 placed horizontally with respect to the post 72*a* and 72*b* can exert a maximum influence over the shock. These two merits are a significant improvement over the prior art made possible only with the present invention.

While this invention has been described in connection with a specific embodiment, it will be understood that it is capable of further modification, and this application is intended to cover any variations, uses, or adaptations of the invention following, in general, the principles of the invention and including such departures from the present disclosure as come within known or customary practice in the art to which the invention pertains, and as may be applied to the essential features hereinbefore set forth and fall within the scope of the invention or the limits of the appended claims.

What is claimed is:

1. In a sports racket having a frame defined by a top section, two opposed side portions, a throat or shank section and a handle, the improvement comprising:

a string network having longitudinal strings and transverse cross strings defining a string network and wherein the axes of a portion of said longitudinal strings converge to a point within the handle, and a string seating member secured to the frame adjacent the throat section, said portion of longitudinal strings being arranged to extend from the top section of the frame to and around said seating member and back to the top section wherein said portion of longitudinal strings extending unobstructed to and around said seating member is arranged approximately in the plane of said string network in approximately concentric circular arcs.

2. The sports racket defined in claim 1 wherein said portion of longitudinal strings comprise at least one-third of the total of said longitudinal strings.

3. The sports racket defined in claim 1 wherein said string seating member is formed with approximately concentric openings arranged in a plane generally coincident to the plane of the string network and into which said portion of longitudinal strings are positioned.

4. The sports racket defined in claim 1 wherein said string seating member includes a seat post secured to the side portions across the throat section, and a string contacting element positioned between said seat post and said portion of strings which extends around said seating member, said string contacting member being arranged in contact with said portion of longitudinal strings.

5. The sports racket defined in claim 4 including a damping member positioned between said seat post and said contacting element for damping vibrations induced upon said portion of strings upon impact thereof by a sports ball.

6. The sports racket defined in claim 5 wherein adhesive material is applied between said damping member and said contacting element.

7. The sports racket defined in claim 5 wherein adhesive material is applied between said damping member and said seat post.

8. The sports racket defined in claim 4 wherein said string contact element having two half sections separated at a plane coinciding with the plane of the string network with each half section accommodating about one half of the the strings extending around said string seating member.

* * * * *